US005623723A

United States Patent [19]

Greenfield

[11] Patent Number: 5,623,723

[45] Date of Patent: Apr. 22, 1997

[54] HARD COMPOSITE AND METHOD OF MAKING THE SAME

[76] Inventor: Mark S. Greenfield, 119 Cheshire Dr., Greensburg, Pa. 15601

[21] Appl. No.: 514,293

[22] Filed: Aug. 11, 1995

[51] Int. Cl.[6] ..... B22F 1/00

[52] U.S. Cl. ..... 419/6; 419/19; 428/547

[58] Field of Search ..... 419/6, 13, 14, 419/15, 16, 19, 23, 32, 38; 75/232, 233, 236, 237, 240; 428/547, 548, 552; 175/426

[56] References Cited

U.S. PATENT DOCUMENTS

| | | | |
|---|---|---|---|
| Re. 34,180 | 2/1993 | Nemeth et al. | 428/547 |
| 2,888,247 | 5/1959 | Haglund | 255/63 |
| 3,994,692 | 11/1976 | Rudy | 29/182.5 |
| 4,063,940 | 12/1977 | Dain et al. | 419/30 |
| 4,194,790 | 3/1980 | Kenny et al. | 299/79 |
| 4,359,335 | 11/1982 | Garner | 75/208 R |
| 4,470,514 | 9/1984 | Abrahamson et al. | 175/410 |
| 4,484,644 | 11/1984 | Cook et al. | 175/410 |
| 4,705,124 | 11/1987 | Abrahamson et al. | 175/410 |
| 4,722,405 | 2/1988 | Langford, Jr. | 175/374 |
| 4,854,405 | 8/1989 | Stroud | 175/374 |
| 4,906,528 | 3/1990 | Cerceau et al. | 419/6 X |
| 4,923,512 | 5/1990 | Timm et al. | 419/16 X |
| 4,961,780 | 10/1990 | Pennington, Jr. | 75/238 |
| 5,116,416 | 5/1992 | Knox et al. | 75/238 |
| 5,333,520 | 8/1994 | Fischer et al. | 76/108 |
| 5,527,624 | 6/1996 | Higgins et al. | 419/19 X |
| 5,543,235 | 8/1996 | Mirchandani et al. | 419/38 X |

FOREIGN PATENT DOCUMENTS

| | | |
|---|---|---|
| 0072175 | 2/1983 | European Pat. Off. . |
| 0111600 | 6/1984 | European Pat. Off. . |
| 0194018 | 9/1986 | European Pat. Off. . |
| 0233162 | 8/1987 | European Pat. Off. . |
| 0257869 | 3/1988 | European Pat. Off. . |
| 0332463 | 9/1989 | European Pat. Off. . |
| 0497781 | 8/1992 | European Pat. Off. . |
| 2304590 | 10/1976 | France . |
| 2343885 | 3/1977 | France . |
| 8813731 | 5/1989 | Germany . |
| 52-110209 | 9/1977 | Japan . |
| 59-107060A | 1/1984 | Japan . |
| 4128330A | 1/1992 | Japan . |
| 911461 | 11/1962 | United Kingdom . |
| 1115908 | 10/1965 | United Kingdom . |
| 1383429 | 2/1974 | United Kingdom . |
| 1404752 | 9/1975 | United Kingdom . |
| 2017153 | 3/1979 | United Kingdom . |
| 2211875 | 7/1989 | United Kingdom . |

OTHER PUBLICATIONS

PCT Search Report Mailed Nov. 14, 1996.

Viswanadham, R. K., "Stability of Microstructural Discontinuities in Cemented Carbides," International Journal of Powder Metallurgy, Oct. 1987, USA, vol. 23, No. 4, ISSN 0361–3488, pp. 229–235.

Richter, V., "Fabrication and Properties of Gradient Hard Metals," 3rd International Symposium on Structural and Functional Gradient Materials, Proceediangs of FGM, '94, Lausanne, Switzerland, 10–12 Oct. 1994, 1995, Lausanne, Switzerland, Presses Polytech, Univ. Romandes, Switzerland, whole document.

"Modern Developments in Powder Metallurgy," Proceedings of the 1980 International Powder Metallurgy Conference, Hausner, Henry H. et al., vol. 14, at pp. 269–279.

(List continued on next page.)

*Primary Examiner*—William P. Neuder
*Attorney, Agent, or Firm*—Stanislav Antolin

[57] ABSTRACT

A method of heat treating a green compact having an exposed surface. The method includes the steps of: providing a green compact comprised of a hard carbide and binder; placing a powder of grain refiner on at least one portion of the exposed surface of the green compact; and heat treating the green compact and grain refiner powder so as to diffuse the grain refiner toward the center of the green compact thereby forming a peripheral zone inwardly from the exposed surface in which the grain refiner was placed, and forming an interior zone. The peripheral zone having a grain size that is smaller than the grain size of the bulk zone.

22 Claims, 5 Drawing Sheets

OTHER PUBLICATIONS

Santhanam, A. T., et al., "An Advanced Cobalt–Enriched Grade Designed to Enhance Machine Productivity," Paper 8503–003, at ASM Conference on Machining, May 7–9, 1995, Metals Park, OH.

Nemeth et al., "The Microstructural Features and Cutting Performance of the High Edge Strength Kennametal Grade KC850," Proc. Tenth Plansee Seminar, 1981, at pp. 613–627.

Santhanam, A. T., et al., "Cemented Carbides," Reprinted from ASM Metals Handbook, vol. 2, 10th Ed., (1980) pp. 950–977.

HARD COMPOSITE AND METHOD OF MAKING THE SAME

BACKGROUND

The invention pertains to a hard composite that is made via sintering techniques. More specifically, the invention pertains to a hard composite that is made via sintering techniques wherein there are two distinct microstructural zones having complementary properties.

In hard composites like cemented tungsten carbides, the grain size, as well as the binder (e.g., cobalt) content each has an influence on the performance of the composite. For example, a smaller or finer grain size of the tungsten carbide results in a stronger and more wear resistant material. An increase in cobalt content typically leads to an increase in toughness. Thus, for certain applications there has been the desire to have a cemented carbide body that exhibits a finer grain size and desirable binder levels.

Heretofore, persons have been able to produce a hard composite having a fine grain size through the incorporation of grain refiners in the initial powder blend. This hard composite has a fine grain size throughout its microstructure. Persons have been able to make a hard body with a coarse grain size via sintering without the incorporation of any grain refiners since the tendency of a hard composite like a WC-Co composite is for the WC grains to coarsen during sintering. This hard composite has a coarse grain size throughout its microstructure. As can be appreciated these hard bodies have a uniform microstructure throughout and do not present a dual zone microstructure.

Persons have tried to produce a hard composite having two distinct microstructural zones. For example, Japanese Disclosure No. 52-110209 discloses two basic processes for making a cemented carbide product with two distinct zones. In one process, a green compact of 80 weight percent WC, 10 weight percent TiC and 10 weight percent Co was spray-coated with a slurry of 90 weight percent WC and 10 weight percent Co. After the coating dried, the substrate (and layer) was sintered, and then coated. In another process, a green compact of 94 weight percent WC and 6 weight percent Co was covered with a layer of 90 weight percent WC/10 weight percent Co powder. The compact was sintered, and then coated.

European Patent No. 194,018 shows the orientation of a cemented carbide part with a coarse-grained interior and a finer-grained exterior wherein the principal focus of the '018 European Patent is on a wire drawing die. In the manufacture of a wire drawing die, a large diameter mandrel helps form the geometry of the outer finer-grained zone, and the outer zone is pre-pressed. A small diameter mandrel helps form the geometry of the inner coarse grained zone. The entire compact is then sintered.

European Patent No. 257,869 discloses a cutting element made according to the following steps: (1) mixing a crown mixture of tungsten carbide powder and cobalt powder, with the cobalt powder being in the range of four to eleven percent (preferably nine to eleven percent) of the crown mixture; (2) mixing a core mixture of tungsten carbide powder and cobalt powder, with the cobalt powder being in the range of about twelve to seventeen percent (preferably fifteen to seventeen percent) of the core mixture; (3) providing a die having a cavity approximately the shape of the cutting element to be formed; (4) positioning in the cavity a quantity of the crown mixture in the shape of a crown defining at least the majority of the outer surface for the tip portion of the cutting element using a pressure of less than about 600 pounds per square inch; (5) positioning in the cavity a quantity of the core mixture sufficient to form almost all of the base portion and at least an inner part of the tip portion of the cutting element; (6) pressing the two quantities of the crown and core mixtures together and into the die at pressures in the range of about ten to fifteen tons per square inch; and (7) sintering the pressed insert (e.g., for about sixty minutes at about fourteen hundred degrees Centigrade) to form the cutting element.

None of these earlier documents shows a method of making a hard component with a dual zone microstructure wherein a powder is placed in contact with the surface of a green compact prior to sintering. This powder is sacrificial in that it does not form a microstructural zone. This powder also acts to influence the microstructure of the green compact during sintering.

Typical applications that would find hard composites with a dual zone microstructure useful, i.e., a peripheral zone of a finer grain size and an interior zone of a coarser grain size, are mining applications, construction applications, wear applications, and metalcutting applications. In the mining applications, mining tools like roof bits, open face style tools, and conical style tools would find a use for a hard insert with the dual zone microstructure. In the construction application, rotatable construction tools would find a hard insert with a dual zone microstructure to be advantageous. Wear parts like wire drawing dies would also find a hard component with a dual zone microstructure to be advantageous. In metalcutting applications, a cutting tool that has a dual zone microstructure would be advantageous.

SUMMARY

It is an object of the invention to provide an improved method of making a dual zone hard composite, as well as the hard composite that has a dual zone microstructure.

It is another object of the invention to provide an improved method of making a dual zone hard composite, as well as the hard composite, that has a peripheral zone of a finer grain size and an interior zone that has a coarser grain size.

It is another object of the invention to provide an improved method of making a dual zone hard composite, as well as the hard composite, that has a peripheral zone of a finer grain size along with a higher binder content and an interior zone that has a coarser grain size and a lower binder content.

In one form thereof, the invention is a method of heat treating a green compact having an exposed surface. The method comprises the steps of: providing a green compact comprised of a hard carbide and binder; placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed, and forming an interior zone, the peripheral zone having a grain size that is smaller than the grain size of the interior zone.

In another form thereof, the invention is an excavation tool for impingement upon a substrate, the tool comprising a tool body; a hard insert produced by a process comprising the following steps: providing a green compact comprised of a hard carbide and binder; placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed and forming an interior zone, the peripheral zone having a grain size that is smaller than the grain size of the interior zone.

In still another form the invention is a hard insert produced by a process comprising the following steps: providing a green compact comprised of a hard carbide and binder; placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed and forming an interior zone, the peripheral zone having a grain size that is smaller than the grain size of the interior zone.

BRIEF DESCRIPTION OF THE DRAWINGS

The following is a brief description of the drawings which form a part of this patent application.

DETAILED DESCRIPTION

Figure 1:
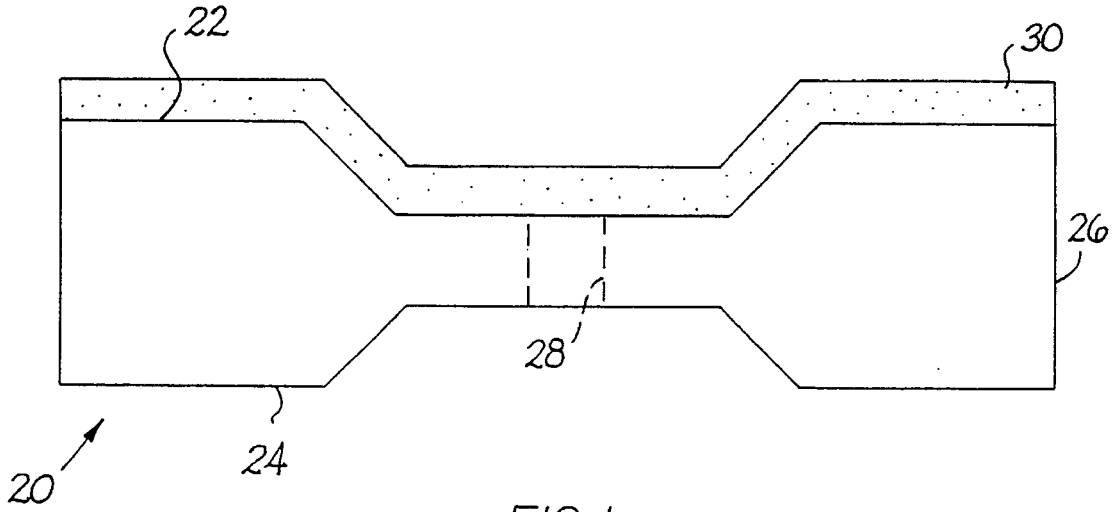
FIG. 1 is a side view of a test sample (cutting tool) comprising a green compact with a layer of grain refiner powder on the top surface thereon prior to being subjected to a heat treating step.

FIG. 1. shows a side view of a green compact for an indexable cutting tool generally designated as 20. The use of a cutting tool as a specific embodiment should not be considered as limiting to the scope of the invention. The invention has application to a wide scope of hard components including hard inserts for mine tools, hard inserts for construction tools, and wear parts such as wire drawing dies.

The green compact 20 includes a top surface 22, a bottom surface 24 and a peripheral edge surface 26. The top surface 22, the bottom surface 24 and the peripheral edge surface 26 together define a volume of the hard component. The green compact 20 contains a central hole 28.

The green compact is the result of a process that includes the steps of blending powder components into a powder blend and then pressing the powder blend into the green compact. The green compact for a cobalt cemented tungsten carbide composition has a density that is sixty percent of the theoretical density.

A layer 30 of a grain refiner in powder or other form is positioned on the top surface 22 of the green compact 20. Although this specific embodiment illustrates the grain refiner as being on the entire top surface only, it is contemplated that the grain refiner 30 could be on selective areas of one or more of the surfaces of the green compact. The positioning of the grain refiner is not limited to covering the entire top surface of the green compact.

In those instances where the green compact 20 comprises tungsten carbide and cobalt, the preferred grain refiners are vanadium carbide, chromium carbide, tantalum carbide or niobium carbide. In addition, the grain refiner can, however, comprise one or more of the carbonitrides, oxides, hydrides or nitrides of vanadium, chromium, tantalum or niobium.

Figure 2:
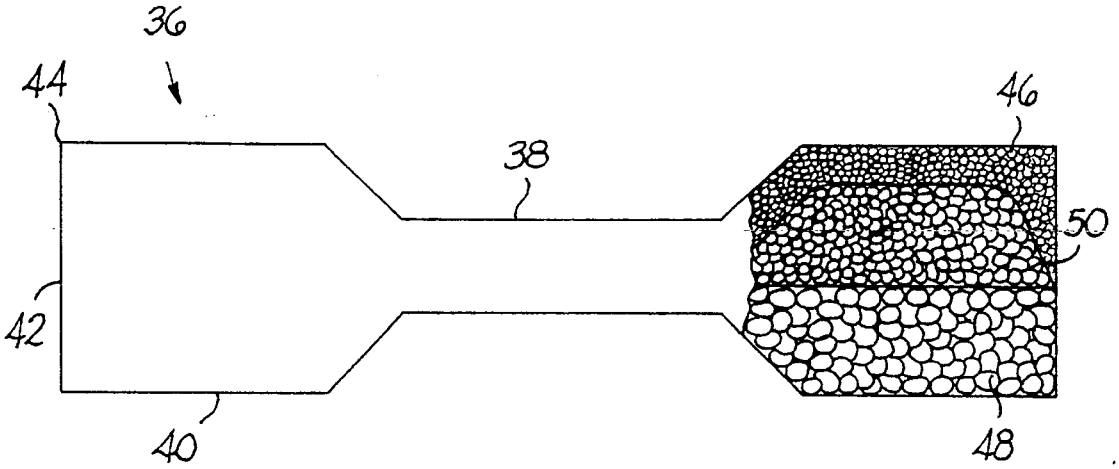
FIG. 2 is a side cross-sectional view of a part of the sample of FIG. 1 so as to show the microstructural zones after the heat treating step and after any residue of the grain refiner has been removed from the surface of the sample.

The combination of the green compact 20 and the layer 30 of grain refiner is sintered, i.e., subjected to a heat treatment, for a pre-selected time at a pre-selected temperature. The resultant product of the sintering is shown in FIG. 2. FIG. 2 shows a portion of the sintered body in cross-section. This resultant product is a substantially fully dense sintered body 36. Although the end product for this specific embodiment is a substantially fully dense sintered body, the resultant body of the heat treatment may be a partially sintered body so that the applicant does not intend to limit the scope of the invention to a substantially fully dense sintered body, but the invention includes a partially sintered body as the resultant product.

Sintered body 36 may require removal of the residue from the grain refiner depending upon the particular sintering parameters and the composition of the sintered product. This residue is typically removed through grinding of the surface.

The sintered body 36 includes a top surface 38, a bottom surface 40, a peripheral side surface 42, and a cutting edge 44. The cross-section of the sintered body 36 reveals three distinct zones of microstructure, i.e., microstructural zones. These microstructural zones comprise a peripheral zone 46, an interior zone 48, and a transition zone 50. These distinct microstructural zones are the result of the different impact (or influence) the grain refiner has on the microstructure.

As a result of the sintering operation, the grain refiner diffuses into the green compact at the surface. As can be expected, the grain refiner diffuses inwardly. The depth of diffusion is dependent upon the time and temperature of the sintering operation. It is the typical case that either one of a longer sintering time or a higher sintering temperature will increase the depth of diffusion of the grain refiner.

The maximum concentration of the grain refiner is in the peripheral microstructural zone 46. The consequence of this is that the grain size is the finest in the peripheral zone 46 than in the other zones. Another consequence is that the binder content in the peripheral zone 46 is higher than the binder content in the other zones. This is due to the tendency of the binder metal to diffuse toward regions with a finer grain size.

No grain refiner diffused into the interior microstructural zone. Consequently, the grain refiner had no direct impact or influence on the grain size of the tungsten carbide in the interior microstructural zone 48.

The tungsten carbide grains in the interior zone increased or coarsened in size during the sintering process.

The refinement of the grains in the peripheral microstructural zone influenced the binder content in the interior microstructural zone in that the diffusion of binder toward the peripheral microstructural zone results in a reduction of the binder in the interior microstructural zone.

The transition microstructural zone 50 had some grain refiner diffuse therein so that the grain size of the tungsten carbide in the transitional zone 50 is not as fine as the tungsten carbide in the peripheral microstructural zone 46 and not as coarse as the tungsten carbide in the interior microstructural zone 48. The binder content in the transition microstructural zone 50 is higher than the binder content in the interior microstructural zone 48, but lower than in the peripheral microstructural zone 46.

An example using the cutting tool as generally depicted in FIGS. 1 and 2, was carried out in accordance with the following description.

A green compact having a composition of 9.75 weight percent cobalt and the balance consisting essentially of tungsten carbide (with the impurities including ≦0.1 weight percent tantalum, ≦0.1 weight percent niobium, and ≦0.1 weight percent titanium) had vanadium carbide powder placed on the top surface thereof. The green compact with the powder on the top surface thereof was sintered at 2700° F. for 45 minutes in a 15 torr argon atmosphere. After sintering, the sample was sectioned and analyzed.

The top surface of the sintered body, which was the surface adjacent the vanadium carbide powder, had a hardness of Rockwell A 91.4. The bottom surface of the sintered body had a hardness of Rockwell A 90.6.

To quantify the cobalt distribution within the sintered body, a mounted and polished sample was analyzed by standardless spot probe analysis using energy dispersive x-ray analysis (EDS). Specifically, a JSM-6400 scanning electron microscope (Model No. ISM64-3, JEOL Ltd., Tokyo, Japan) equipped with a $LaB_6$ cathode electron gun system and an energy dispersive x-ray system with a silicon-lithium detector (Oxford Instruments, Inc., Analytical System Division, Microanalysis Group, Bucks, England) at an accelerating potential of about 20 keV was used. The scanned areas measured about 125 micrometers by about 4 micrometers. Each area was scanned for equivalent time intervals (about 50 seconds live time). The step size between adjacent areas was about 2 micrometers. The result of this analysis is shown in FIG. 8.

Figure 8:
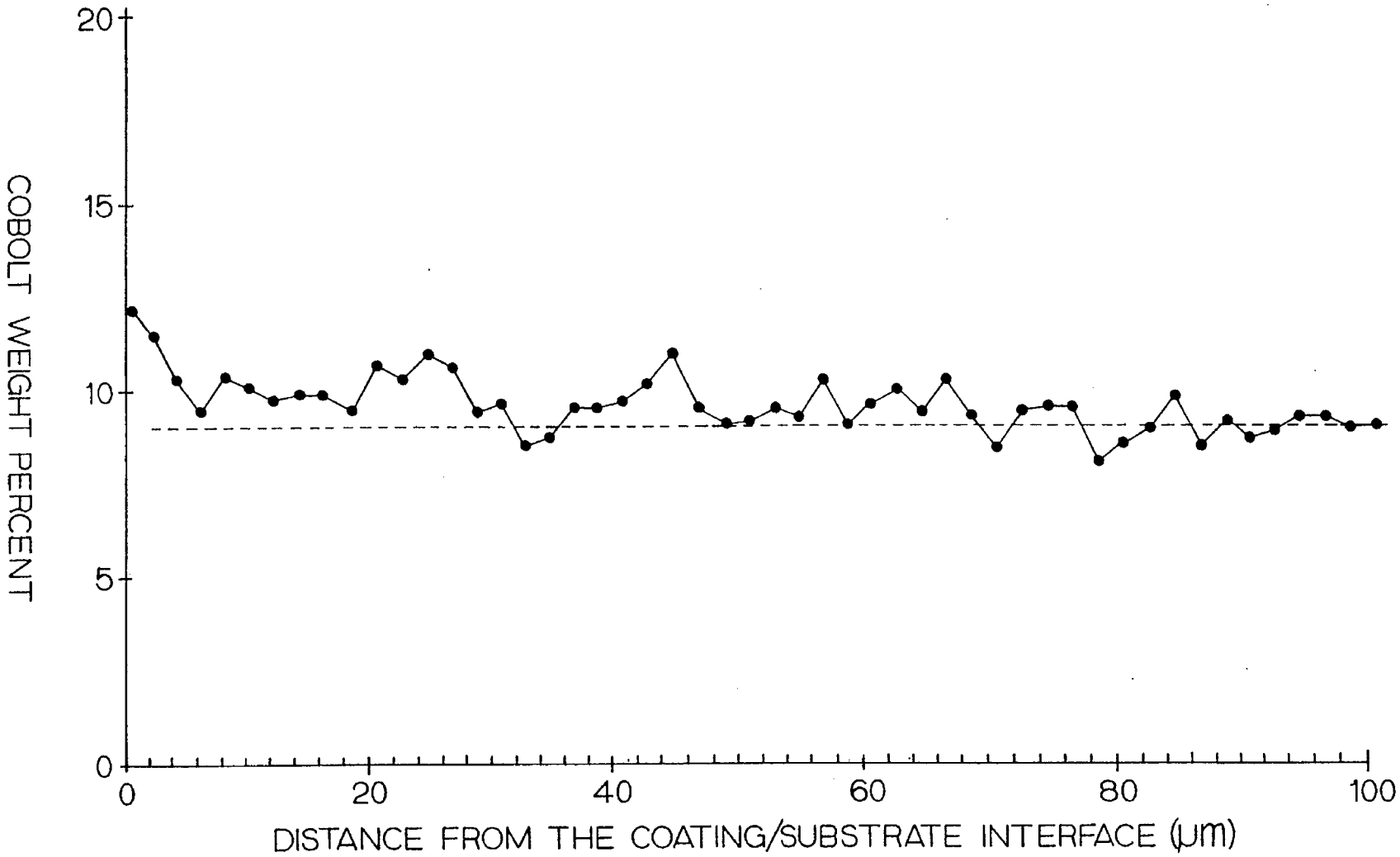
FIG. 8 is a cobalt profile for the test sample of FIG. 1.

As shown in FIG. 8, there appears to be some cobalt enrichment in the peripheral microstructural zone. In this regard, the cobalt content at the surface and in the peripheral zone reaches as high as about 130 percent of the bulk cobalt content. The cobalt content remains generally above the bulk cobalt content for about 70 to 80 micrometers from the surface of the sintered body, although there are some measurements that fall below the bulk cobalt content within 80 micrometers of the surface.

The peripheral microstructural zone had a WC grain size of 1 to 3 micrometers, and a porosity of A02+B00+C00. The transition microstructural zone had a WC grain size of 1 to 4 micrometers along with numerous cobalt pools and stringers to 7 micrometers in length. The transition microstructural zone had a porosity of A08/10+B00+C00. The interior microstructural zone had a WC grain size of 1 to 6 micrometers, and a porosity of A02+B00+C00.

Figure 3:
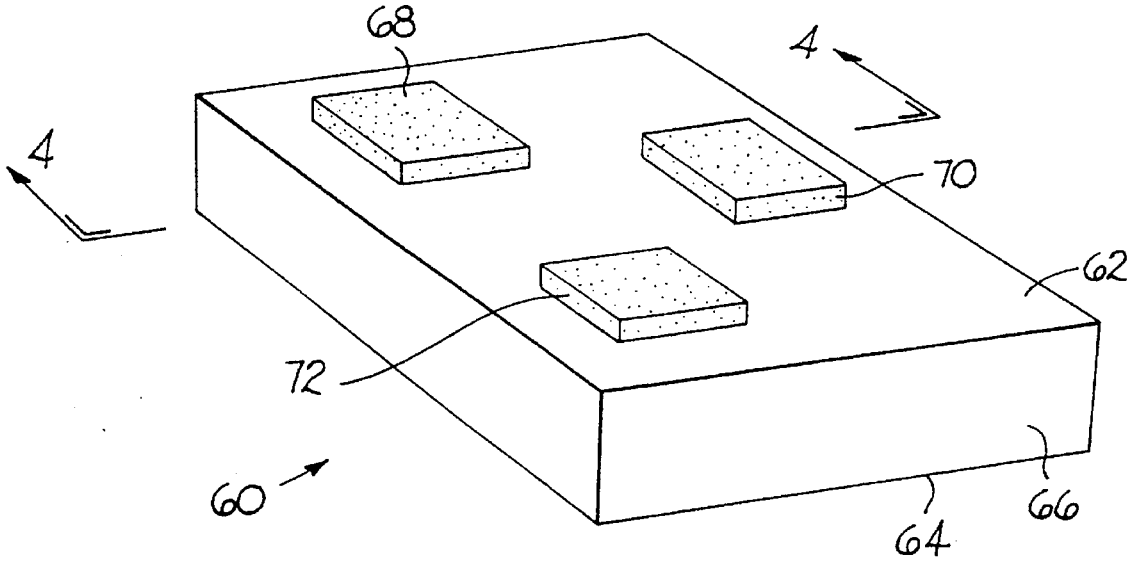
FIG. 3 is a perspective view of a green compact of a hard component with a plurality of volumes of grain refiner powder at selected locations on the surface of the green compact prior to the combination being subjected to a heat treating step.

FIG. 3 depicts a green compact cemented carbide body generally designated as 60 that has a top surface 62, a bottom surface 64, and a peripheral edge surface 66. The top surface 62, the bottom surface 64 and peripheral edge 66 define the volume of the green compact. Three distinct volumes of a grain refiner in powder form (68, 70, 72) are positioned on the top surface 62 of the green compact 60.

Figure 4:
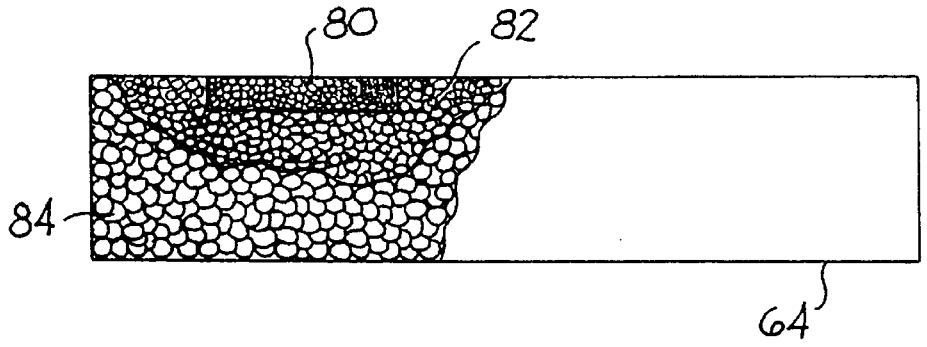
FIG. 4 is a cross-sectional view of a part of the hard component of FIG. 3 showing the microstructural zones after the heat treating step and the removal of any residue from the surface of the component.

During the sintering operation, each volume of the grain refiner diffuses into the green compact, thereby forming a peripheral microstructural zone and a transition microstructural zone in the region of each one of the powder volumes. The bulk of the microstructure comprises the interior microstructural zone. FIG. 4 depicts the sintered body 78 and shows the peripheral microstructural zone 80 and the transition microstructural zone 82 associated with the powder volume, and the interior microstructural zone 84.

Figure 5:
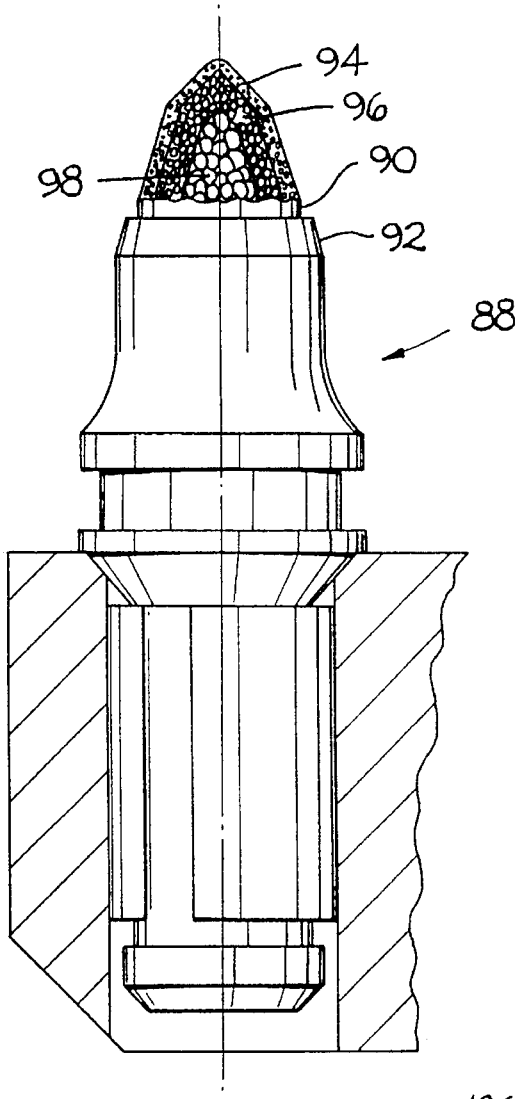
FIG. 5 is a side view of a construction tool using a hard insert with the dual microstructural zones wherein a part of the hard insert is illustrated in section.

FIG. 5 depicts a rotatable construction tool 88 that includes a cemented carbide (WC-Co) hard insert 90 at the axially forward end 92 thereof. FIG. 5 shows a part of the hard insert 90 in cross-section so as to reveal the peripheral microstructural zone 94, the transition microstructural zone 96, and the interior microstructural zone 98.

Figure 6:
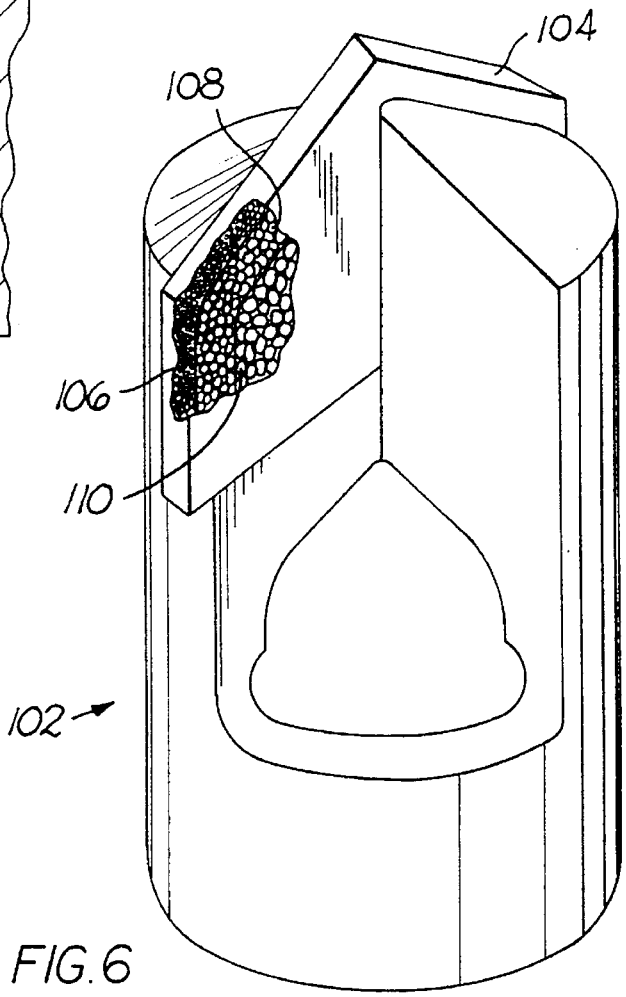
FIG. 6 is a perspective view of a roof bit tool using a hard insert with the dual microstructural zones wherein a part of the hard insert is illustrated in section.

FIG. 6 shows a roof drill bit 102 that has a cemented carbide (WC-Co) hard insert 104. FIG. 6 shows the hard insert 104 in cross-section so as to reveal the peripheral microstructural zone 106, the transition microstructural zone 108, and the interior microstructure zone 110.

Figure 7:
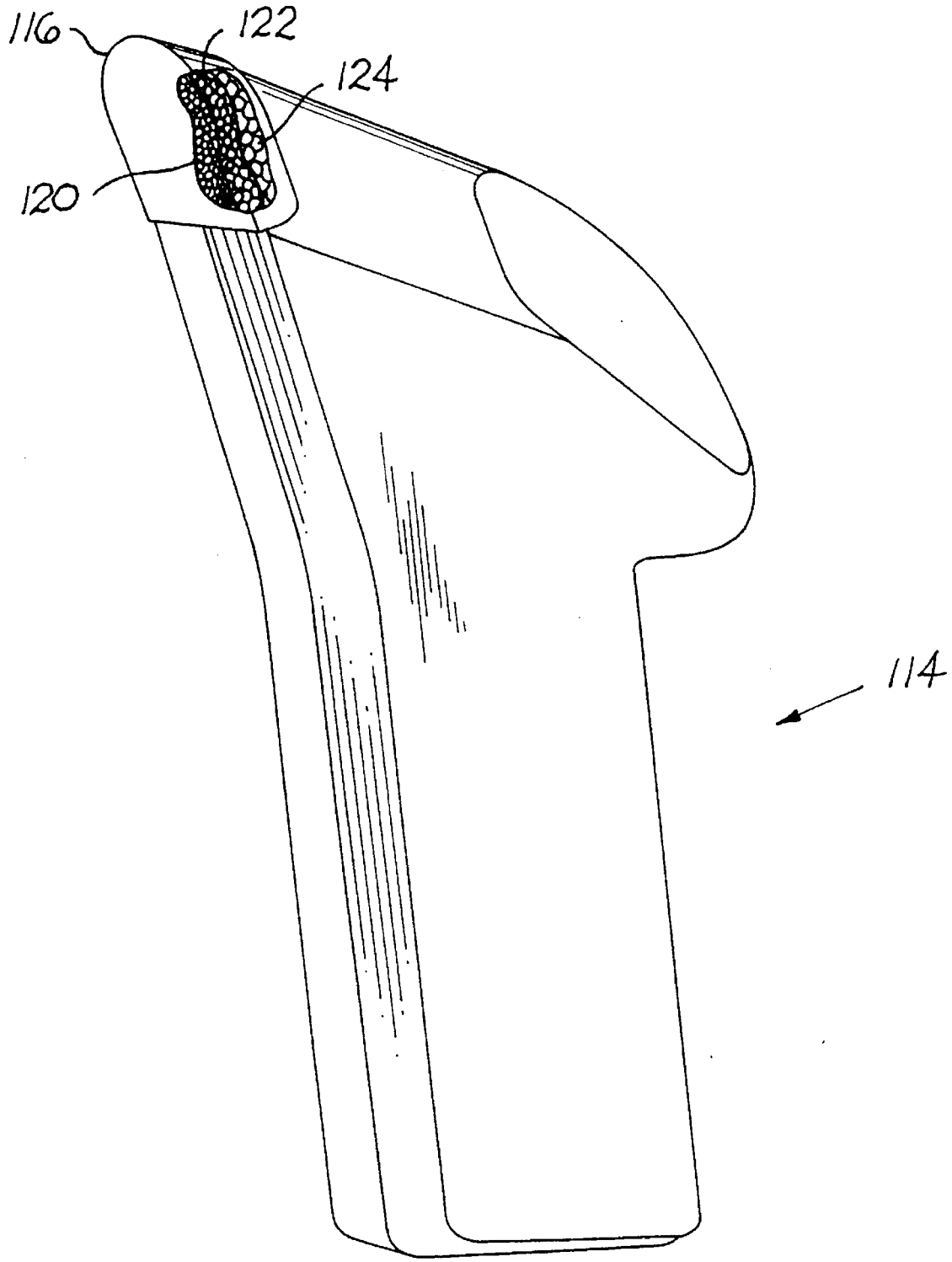
FIG. 7 is a perspective view of an open face style of mine tool using a hard insert with the dual microstructural zones wherein a part of the hard insert is illustrated in section.

FIG. 7 shows an open face style of tool 114 with a hard insert 116 at the forward end 118 thereof. FIG. 7 illustrates the hard insert 116 in cross-section so as to reveal the peripheral microstructural zone 120, the transition microstructural zone 122, and the interior microstructural zone 124.

Like for the sample of FIG. 2, for each one of the tools depicted in FIGS. 5 through 7 the peripheral transitional zone has the finest grain size and the highest binder content. The interior transitional zone has the coarsest grain size and the lowest binder content. The transition microstructural zone has a grain size and binder content that is between that of the peripheral microstructural zone and the interior microstructural zone.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A method of heat treating a green compact having an exposed surface, the method comprising the steps of:

providing a green compact comprised of a hard carbide and binder;

placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed, and forming an interior zone, the peripheral zone having a grain size that is smaller than the grain size of the interior zone.

2. The method of claim 1 further including the step of blending the hard carbide and binder so as to form a powder blend, and forming the powder blend into a green compact.

3. The method of claim 1 wherein the grain refiner is in powder form.

4. The method of claim 1 wherein the heat treating step further includes forming a transition zone between the peripheral zone and the interior zone.

5. The method of claim 1 wherein during the heat treatment the grain size of the hard carbide in the bulk zone increases from its initial size.

6. The method of claim 1 wherein during the heat treatment the grain size of the hard carbide in the peripheral zone decreases from its initial size.

7. The method of claim 1 wherein during the heat treatment the binder metal migrates from the interior zone toward the peripheral zone.

8. The method of claim 1 wherein the green compact contains between none and an ineffective amount of grain refiners.

9. The method of claim 1 wherein the green compact comprises tungsten carbide and cobalt.

10. The method of claim 1 wherein the grain refiner comprises one or more of the carbides, carbonitrides, oxides, hydrides or nitrides of vanadium, chromium, tantalum or niobium.

11. The method of claim 1 wherein the grain refiner is selected from the group consisting of VC, $Cr_3C_2$, TaC, and NbC.

12. An excavation tool for impingement upon a substrate, the tool comprising:

a tool body;

a hard insert produced by a process comprising the following steps: providing a green compact comprised of a hard carbide and binder; placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed and forming an interior zone, the peripheral zone having a grain size that is smaller than the grain size of the interior zone.

13. The excavation tool of claim 12 wherein the tool body is elongated and is generally symmetrical so as to be rotatable about its central longitudinal axis, the tool body has a socket at its forward end, a portion of the hard insert being received within the socket.

14. The excavation tool of claim 13 wherein the portion of the surface of the hard insert outside of the socket comprises an impingement surface which impinges the substrate.

15. The excavation tool of claim 12 wherein the tool is nonrotatable.

16. A hard insert produced by a process comprising the following steps:

providing a green compact comprised of a hard carbide and binder;

placing a grain refiner on at least one portion of the exposed surface of the green compact; and heat treating the green compact and grain refiner so as to diffuse the grain refiner toward the center of the green compact thereby forming a peripheral zone inwardly from the exposed surface on which the grain refiner was placed and forming an interior zone, the peripheral zone having a grain size that is smaller than the grain size of the interior zone.

17. The hard insert of claim 16 wherein the heat treating step further includes forming a transition zone between the peripheral zone and the interior zone.

18. The hard insert of claim 16 wherein during the heat treatment the grain size of the hard carbide in the bulk zone increases from its initial size.

19. The hard insert of claim 16 wherein during the heat treatment the grain size of the hard carbide in the peripheral zone decreases from its initial size.

20. The hard insert of claim 16 wherein during the heat treatment the binder metal migrates from the interior zone toward the peripheral zone.

21. The hard insert of claim 16 wherein the green compact comprises tungsten carbide and cobalt, and the grain refiner comprises VC, $Cr_3C_2$, TaC, or NbC.

22. The hard insert of claim 16 wherein the green compact comprises tungsten carbide and cobalt, and the grain refiner comprises one or more of the carbides, carbonitrides, oxides, hydrides or nitrides of vanadium, chromium, tantalum or niobium.

* * * * *